United States Patent [19]

Wright

[11] 4,072,920

[45] Feb. 7, 1978

[54] MAGNETIC HOLDING DEVICE

[75] Inventor: Theodore D. Wright, St. Paul, Minn.

[73] Assignee: K & F Manufacturing Co., Inc., Granger, Ind.

[21] Appl. No.: 670,829

[22] Filed: Mar. 26, 1976

Related U.S. Application Data

[63] Continuation of Ser. No. 556,686, March 10, 1975, abandoned.

[51] Int. Cl.[2] ..... H01F 7/20

[52] U.S. Cl. ..... 335/285; 101/382 MV

[58] Field of Search ..... 335/285, 295, 303, 306; 101/378, 382 MV

[56] References Cited

U.S. PATENT DOCUMENTS

| | | | |
|---|---|---|---|
| 3,616,145 | 10/1971 | Clifton | 335/303 X |
| 3,824,926 | 7/1974 | Fukuyama | 101/378 |

*Primary Examiner*—George Harris

*Attorney, Agent, or Firm*—Craig & Antonelli

[57] ABSTRACT

A permanent magnet holding plate comprises a thin base sheet of stiff, nonmagnetic material with a multiplicity of pole pieces made of strips of magnetic material extending across the base plate but separated from one another, and strips of compressible permanent magnet material locatedin the spaces between the pole pieces and in intimate contact therewith and polarized to induce magnetic poles of opposite polarity in successive pole pieces. In a preferred embodiment, the base plate is curved to form a magnetic holding saddle and the pole pieces and permanent magnet strips are transverse to the curvature of the plate.

10 Claims, 5 Drawing Figures

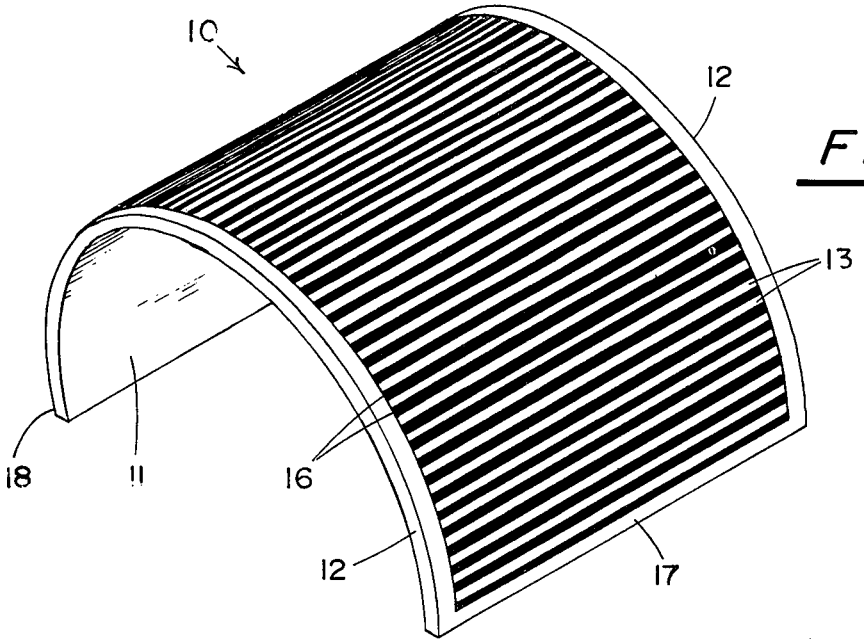
FIG. 1
FIG. 2
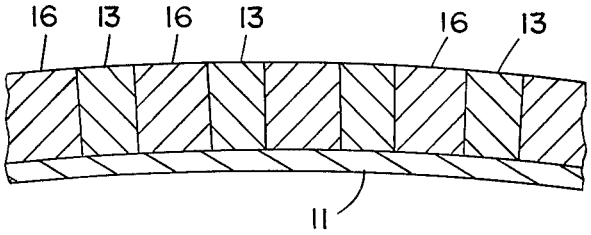
FIG. 3
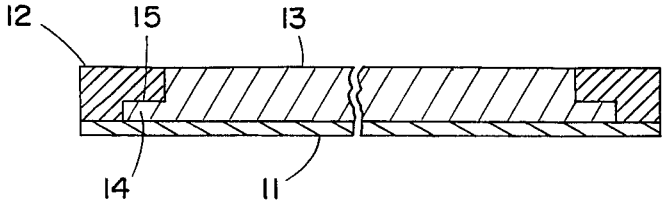

MAGNETIC HOLDING DEVICE

This is a continuation of application Ser. No. 556,686 filed Mar. 10, 1975, now abandoned.

BACKGROUND OF THE INVENTION

1. Field of the Invention

This invention is in the field of permanent magnet holding plates. A primary use is as a magnetic holding saddle for a printing press roll or cylinder for holding a flexible, steel-backed printing plate in place during the printing operation.

2. Description of the Prior Art

A prior art magnetic cylinder or saddle for a printing press is disclosed in U.S. Pat. No. 3,810,055 by Theodore D. Wright. Although the U.S. Pat. No. 3,810,055 device can be used for other purposes, it is primarily for use as a magnetic holding device to hold a flexible or curved steel-backed printing plate without the need for mechanical clamp or the like which has been necessary in the past. The device described in the '055 patent is constructed by spiraling a pair of elongated strips of flexible permanent magnets in a pair of parallel spiraling grooves around a cylinder. Between the magnet strips are strips of magnetic material and the permanent magnets induce magnetic poles into the magnetic material strips so they become pole pieces and concentrate the magnetic lines of force near the surface of the cylinder to create a strong magnetic holding force to hold the printing plate in place on the cylinder. Another device which finds its principal use as a magnetic holder for a printing plate is shown in U.S. Pat. No. 3,824,927 by Pugh et al. Here the magnetic holding device is formed by a sheet or layer of magnetic rubber placed over a curved steel supporting layer.

While both of the aforementioned devices may work well and may be meritorious, they do have certain limitations. One difficulty with the U.S. Pat. No. 3,810,055 device is the problem of making the spirally-wrapped cylinder into a saddle by cutting the cylinder into sections. Another difficulty is the problem that sometimes occurs in assemblying the device in handling the long strips of flexible permanent magnets to arrange them in the slots. Also, there can be some difficulty in ensuring intimate contact between the flexible magnet strips and the adjacent rigid pole pieces to reduce magnetic field loss. Another disadvantage of the U.S. Pat. No. 3,810,055 magnetic holder is that because of the way it is constructed, it cannot be made thin enough to be used in certain applications.

The U.S. Pat. No. 3,824,927 device, without pole pieces, would appear to have insufficient mechanical strength and magnetic holding power so would need auxiliary means for holding the printing plate in place, and is not too durable because the layer of flexible magnet material is located unprotected on the outer surface of the cylinder or saddle. This makes it susceptible to damage during use and handling.

SUMMARY OF THE INVENTION

The magnetic holding device of the instant invention comprises a base support of a thin, stiff sheet of nonmagnetic material with a series of strips of magnetic material, hereinafter referred to as pole pieces, arranged across the base sheet separated from one another and firmly attached to the base plate, and strips of flexible or compressible permanent magnet material located in the spaces between adjacent pole pieces and in intimate contact with the sides of the pole pieces. The permanent magnet strips are polarized so that each induces the same polarity pole in the pole piece which is located between two successive permanent magnet strips so that successive pole pieces have induced poles of opposite magnetic polarity. Preferably, the base plate is curved to the shape of a saddle for a printing press roll and the permanent magnet strips and the pole pieces extend longitudinally transverse to the line of curve of the base plate.

BRIEF DESCRIPTION OF THE DRAWINGS

FIG. 1 is a perspective view of a permanent magnet saddle for a printing cylinder constructed according to the teachings of this invention;

FIG. 2 is a partial section taken parallel to the line of curvature of the saddle;

FIG. 3 is a partial section taken along a line transverse to the line of curvature of the saddle.

DESCRIPTION OF THE PREFERRED EMBODIMENTS

Figure 4:
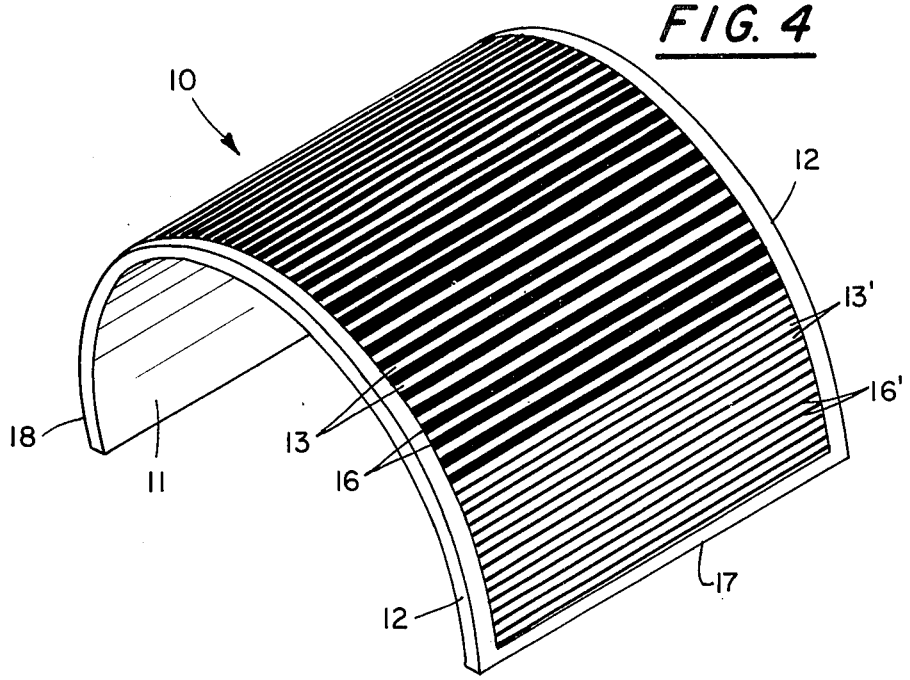
FIG. 4 is a perspective view similar to FIG. 1 showing another preferred embodiment of the invention.

Referring to the drawings, the curved, permanent magnet saddle 10 has a base plate 11 made out of a thin but stiff sheet of nonmagnetic material which, for example, might be aluminum or some other material suitable to provide the necessary base support. Along each side of magnetic saddle 10 is a side rail 12 which runs along the line of curvature for the entire curved length of the saddle. The side rails 12 are preferably made out of the same material as the base plate but need not be, although they too should be made out of a suitable nonmagnetic material. Extending across the top surface of the base plate 11 from side rail to side rail are a series of strips of ferromagnetic material 13. As will become evident later, these strips are referred to as pole pieces. The pole pieces are laid out generally parallel to one another and are spaced apart over the length of the base plate. As can be observed most clearly in FIG. 3, the pole pieces 13 are located and held in place by virtue of shoulders 14 formed on each end of each pole piece 13 engaged in recesses 15 on the inner lower side of the side rails 12. Also located on the top surface of the base plate 11 and in the spaces between successive pole pieces 13 are strips of flexible, permanent magnet material 16. The preferred material for the magnet strips 16 is a rubber bonded barium ferrite composite material which is known commercially under the registered trademark name of "PLASTIFORM" and is made by Minnesota Mining and Manufacturing Company. This material has the characteristic of being flexible enough to be bent or twisted or wound in a variety of shapes or forms and is compressible to some degree and consists of a rubber based matrix or binder containing powdered ferrite particles which are mechanically orientated during processing and aligned and held to constitute a good permanent magnet. Because a flexible permanent magnet material is used, it lends itself to certain advantages because the strips can be inserted between successive pole pieces and be compressed against the pole pieces to make intimate contact with the pole pieces so as to lessen any magnetic loss. The permanent magnet strips 16 are polarized so that successive strips have the same pole on opposite sides of the pole piece between them, as best observed in FIG. 2. In this manner successive pole pieces have magnetic poles of opposite polarity induced in them so that the magnetic lines leaving one pole piece are directed to a next successive pole piece in both directions and tend to concentrate close to the surface of the saddle 10. At each end of base plate 11 is a head piece 17 and a tail piece 18 which serve to lock the pole pieces and the magnetic strips within the confines of the saddle.

The device is preferably assembled by first attaching the tail piece 18 or the head piece 17 to one end of the base plate 11 and then inserting each pole piece 13 by placing the shoulders 14 in the recess 15 of side rails 12 and placing a magnet strip 16 between each of the pole pieces. Pressure can then be applied, in some suitable fashion, lengthwise of the saddle to the sides of a group of assembled pole pieces and magnet strips to compress the latter firmly between successive pole pieces and thereby assure good intimate contact between the pole pieces 13 and the adjacent magnet strips 16. Although the pole pieces can then be served in position in a variety of fashions, it is preferred that a suitable adhesive be applied to the ends of the pole pieces to make sure they do not work loose when the completed saddle is in use.

A feature of this invention is that the underside of the base plate can be machined if necessary to form a slot or recess in order to mechanically attach the saddle to a printing press cylinder roll that uses a tension lockup mechanism. This makes it interchangeable with other printing press saddles without altering the mechanism for latching the saddle to the cylinder. Similarly, the side rails 12 can be beveled if necessary for use on a printing press cylinder where the printing press cylinder has a standard compression lockup device. In other words, the permanent magnetic saddle constructed as taught by the instant invention can easily be adapted for use with traditional printing devices.

Because of the nature of the construction of this device, a concentrated magnetic field can be achieved to produce the magnetic holding strength necessary for the intended purpose yet the saddle can be made quite thin. This is an advantage because then the saddle can be used within the dimensional limits of the printing machines. In the past, the steel-backed printing plate (which replaced the stereotype or electrotype cast lead plate) was mechanically locked onto a printing saddle. This invention holds the steel-backed printing plate with the required holding strength yet can be made within the permissible thickness dimension for the saddle. In this way the location and dimensions of the printing rolls or cylinders need not be altered to accommodate the magnet saddle 10. While the instant embodiment illustrates the pole pieces 13 and permanent magnet strips 16 covering the entire length and breadth of the saddle 10, it has been found that in some instances a printing plate can be securely held in position by having pole pieces and permanent magnet strips only at the tail and front ends of the saddle. This will depend upon the particular application and the degree of holding strength necessary to keep the printing plate in place during the printing operation.

Figure 2A:
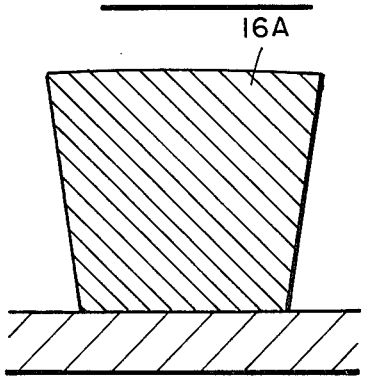
FIG. 2A is a sectional view schematically showing a modified embodiment of a magnet strip useful with the present invention.

It has also been found that the permanent magnet strips 16 can be slightly tapered along their sides to ensure good intimate contact with the adjacent pole pieces 13. FIG. 2A schematically depicts the cross-sectional shape of such a tapered magnet strip 16A. Also, in some cases the permanent magnet strips 16' and pole pieces 13' (FIG. 4 illustration) near the head and tail ends of the saddle may be somewhat thinner than strips 16 and pole pieces 13 in the central area of the saddle so there would be a greater magnetic field concentration in those end areas where a stronger magnetic holding strength may be necessary or desired.

Although the preferred embodiment is shown and described as being arcuate in form, the holding device, for some applications, may be made flat, yet will retain all of the benefits, features and advantages.

A further feature of this invention is that the magnetic field of the holding plate can be arranged and directed so as to provide the means for attaching it to the printing press cylinder, provided the latter is made out of a suitable magnetic material. In other words, the magnetic field can serve a twofold purpose, one being to hold the plate to the printing press cylinder and the other being to hold the steel backed printing plate, and thereby eliminate the need for mechanical locking devices.

I claim:

1. A magnetic device for holding a printing plate or the like comprising:

a base plate made of rigid, substantially non-magnetic material, said base plate exhibiting an arcuately curved outer surface, a plurality of spaced-apart rigid strips of magnetic material arranged at the outer surface of the base plate, magnet strips located in respective spaces between said rigid strips, and mechanical locking means for holding said rigid strips and said magnet strips in position at said base plate, said locking means including recess means at said base plate which are lockingly engageable over the respective extreme axial end portions of said rigid strips and said magnet strips to hold said strips against movement both radially outwardly of said base plate and axially in the direction of said strips.

2. A magnetic device according to claim 1, wherein said magnet strips are formed as compressible magnet strips.

3. A magnetic device according to claim 2, wherein said compressible magnet strips make intimate side-to-side contact with their adjacent rigid strips and are arranged so that the same magnetic pole is located at opposite sides of each rigid strip to form successive rigid strips into magnetically induced pole pieces of opposite polarity.

4. A magnetic device according to claim 2, wherein the compressible magnet strips and the rigid strips extend transverse to the direction of curvature of the base plate, wherein said recess means is formed by side rail means at each side edge of the base plate with recesses formed along the respective undersides of said side rail means, and wherein each of said compressible magnet strips and said rigid strips are notched at each end thereof for fitting into said recesses under said side rail means.

5. A magnetic device according to claim 4, further comprising a head piece and a tail piece disposed at respective opposite ends of said base plate for locking the rigid strips and compressible magnetic strips within the confines of the device, said head piece and tail piece extending transverse to the side rail means.

6. A magnetic device according to claim 4, wherein each of said rigid strips extends from a recess at one of said side rail means to a corresponding recess at a side rail means at the opposite side edge of said base plate.

7. A magnetic device for holding a printing plate or the like comprising:

a base plate made of rigid, substantially nonmagnetic material, said base plate exhibiting an arcuately curved outer surface, a plurality of spaced-apart rigid strips of magnetic material arranged at the outer surface of the base plate and extending transverse to the direction of curvature of said base plate, and compressible magnet strips located in respective spaces between said rigid strips, said compressible magnet strips making intimate side-to-side contact with their adjacent rigid strips and being arranged so that the same magnetic pole is located at opposite sides of each rigid strip to form successive rigid strips and to magnetically induce pole pieces of opposite polarity, said compressible magnet strips being slightly tapered along their sides to insure good intimate contact with adjacent rigid strips.

8. A magnetic device for holding a printing plate or the like comprising:

a base plate made of rigid, substantially non-magnetic material, said base plate exhibiting an arcuately curved outer surface, a plurality of spaced-apart rigid strips of magnetic material arranged at the outer surface of the base plate and extending transverse to the direction of curvature of said base plate, and compressible magnet strips located in respective spaces between said rigid strips, said compressible magnet strips making intimate side-to-side contact with their adjacent rigid strips and being arranged so that the same magnetic pole is located at opposite sides of each rigid strip to form successive rigid strips into magnetically induced pole pieces of opposite polarity, wherein said compressible magnet strips and said rigid strips are disposed and configured on said base plate to effect a greater magnetic field concentration in respective areas of said device which in use are engageable with end portions of the printing plate than in areas intermediate said end portions of the printing plate.

9. A magnetic device according to claim 8, wherein said base plate is in the form of a sheet of said non-magnetic material which is substantially semi-cylindrical in shape to form a magnetic holding saddle for a printing press roll, and wherein the circumferential end portions of said base plate are provided with compressible magnet strips and rigid strips which are thinner than are the compressible magnet strips and rigid strips located intermediate said circumferential end portions.

10. A magnetic device according to claim 8, wherein mechanical locking means are provided for holding said rigid strips and said compressible magnet strips in position at said base plate, said locking means including recess means at said base plate which are lockingly engageable over the respective extreme axial end portions of said rigid strips and said magnet strips to hold said strips against movement both radially outward of said base plate and axially of said strips.

* * * * *